US005765295A

United States Patent [19]

Srourian et al.

[11] Patent Number: 5,765,295

[45] Date of Patent: Jun. 16, 1998

[54] TWO PIECE SHOE BOTTOM CONSTRUCTION

[75] Inventors: Nichan Srourian; Hagop Sardarian, both of Studio City, Calif.

[73] Assignee: Polyplex Plastics of North America Inc., Sun Valley, Calif.

[21] Appl. No.: 593,460

[22] Filed: Jan. 29, 1996

[51] Int. Cl.[6] ..... A43B 13/28

[52] U.S. Cl. ..... 36/24.5; 36/34 R; 36/34 A

[58] Field of Search ..... 36/24.5, 34 A, 36/36 A, 36 L, 42

[56] References Cited

U.S. PATENT DOCUMENTS

| | | | |
|---|---|---|---|
| 2,165,427 | 7/1939 | Vigorith et al. | 36/24.5 |
| 2,303,431 | 12/1942 | Brophy | 36/34 A X |
| 2,912,772 | 11/1959 | Harrison | 36/24.5 X |
| 4,073,074 | 2/1978 | Rabin et al. | 36/24.5 X |
| 4,198,769 | 4/1980 | Rigon | 36/24.5 |
| 4,244,070 | 1/1981 | Ughi | 36/34 A X |

FOREIGN PATENT DOCUMENTS

| | | | |
|---|---|---|---|
| 555776 | 3/1957 | Belgium | 36/24.5 |
| 917910 | 1/1947 | France | 36/24.5 |
| 1188711 | 12/1958 | France | 36/24.5 |
| 1400932 | 4/1965 | France | 36/24.5 |

*Primary Examiner*—Ted Kavanaugh
*Attorney, Agent, or Firm*—Thomas I. Rozsa; Tony D. Chen

[57] ABSTRACT

A two piece shoe bottom construction including a platform structure and a heel structure. The platform structure has a forward toe support portion and a rear raised portion, the rear raised portion being elevated substantially above the toe portion so that it will correspond to a particular height of a heel portion. The heel structure has a heel portion and a downwardly inclined protruding tongue portion integrally formed with the upper front part of the heel portion. The protruding tongue portion has a concave shaped lower side. An alignment anchor is integrally formed with the protruding tongue portion and located at one end which is remote from the heel portion. The platform structure has a closed cavity which extends from the middle of the toe portion through the end of the rear raised portion. The closed cavity is shaped similar to the concave shaped lower side of the protruding tongue so that when the protruding tongue portion is installed within the closed cavity of the platform structure, the upper side of the protruding tongue portion will be flush with the upper side of the platform structure. An alignment aperture is provided within the toe portion so that the alignment anchor projects within the alignment aperture of the platform structure for stabilizing the heel portion.

7 Claims, 7 Drawing Sheets

TWO PIECE SHOE BOTTOM CONSTRUCTION

BACKGROUND OF THE INVENTION

1. Field of the Invention

The present invention relates to the field of design and construction of shoes. More particularly, the present invention relates to a two piece shoe bottom construction for general footwear.

2. Description of the Prior Art

A shoe is generally comprised of an upper, an insole or midsole and a sole. The upper comes in contact with the foot of a user and may be made of leather straps, synthetic material or cloth, and is commonly called a sandal. The upper also may be made to cover the whole foot and is commonly called a pump, moccasin or boot. The insole is the part of the shoe upon which the foot rests. The sole is the part of the shoe which comes in contact with the ground. The function of the sole is to withstand abrasion, be flexible and comfortable. There are several type of soles in the art and they are as follows: (a) a one piece construction made of synthetic plastic or rubber material; (b) a two piece construction attached together, one on top of the other; the upper and lower parts are called a midsole and an outsole respectively; and (c) a two piece construction which is comprised of a platform and a heel. The platform may be made of leather or soft synthetic rubber material to withstand abrasion. The heel provides the desired height of the shoe, and usually the lower side of the heel is attached to a lift or top lift made of leather or synthetic material to withstand abrasion.

All of the above soles are attached to the upper by adhesive means to be pressed and completed as the final shoe, except for the third type, where the heel has to be nailed to a very structurally strong insole. In addition, the insole also provides another function for holding the platform and the heel firmly together. Therefore, it is specially made to provide a body to the shoe and having the function as the backbone in the structure.

High heel shoes are generally constructed of a sole and a high heel. The sole comprises a forward toe support portion and a raised heel portion. An insole overlies the upper surface of the sole and is suitably sealed and secured thereto in a conventional manner. A metal shank is sandwiched between the insole and the sole of the shoe for maintaining rigidness of the shoe. The high heel is then attached to the raised heel portion on the sole of the shoe by conventional means.

One of the problems in constructing the prior art high heel shoes is that they often have very complicated structures. This often increases the manufacturing costs. Another problem with prior art high heel shoes is that they are not durable. Oftentimes the high heel is made of plastic which is hard but can break easily, such as nails coming off or the shank deforming. In most prior art design and construction of the shoe, the high heel is directly attached to the raised heel portion of the insole of the shoe. Therefore, the strength and durability of the attachment is limited by the properties of the materials being used for the construction of the heel and the insole of the shoe.

It is highly desirable to design and construct shoe bottoms which are easy to handle, durable and inexpensive to manufacture. It is desirable to have a very efficient and also very effective design and construction of a two piece shoe bottom construction, wherein all of the problems mentioned above are eliminated. It is also desirable to provide a two piece design of a shoe bottom with the capability of rapidly interchanging the heel and the sole during manufacturing, prior to securing the heel to the sole.

SUMMARY OF THE INVENTION

The present invention is a unique two piece shoe bottom construction which comprises a platform structure and a heel structure. The platform structure has a forward toe support portion and a rear raised portion, the rear raised portion being elevated substantially above the toe portion so that it will correspond to a particular height of a heel.

The heel structure has a heel portion and a downwardly inclined protruding tongue portion integrally molded from the upper front part of the heel portion. The protruding tongue portion has a concave shaped lower side. An alignment anchor is integrally molded on the protruding tongue portion and located at one end which is remote from the heel portion. The platform structure has a closed cavity which extends from the middle of the toe portion through the end of the rear raised portion. The closed cavity is shaped similar to the concave shaped lower side of the protruding tongue of the heel structure so that when the protruding tongue portion is installed within the closed cavity of the platform structure, the upper side of the protruding tongue portion will be flush with the upper side of the platform structure. An alignment aperture is provided within the toe portion so that the alignment anchor projects within the alignment aperture of the platform structure for stabilizing the high heel portion. Once the two piece design of the shoe bottom is secured together by conventional means, the shoe is completed in the conventional way known to one skilled in the art.

The present invention provides a simple yet effective connection between the platform structure and the heel structure.

It is therefore an object of the present invention to provide a two piece shoe bottom construction, wherein the prior art metal steel flexible shank is eliminated.

It is also an object of the present invention to provide a two piece shoe bottom construction with the capability of rapidly interchanging different heel structures with different platform structures during manufacturing and prior to securing the heel structure to the platform structure.

It is an additional object of the present invention to provide a heel structure having a high heel portion and a downwardly inclined protruding tongue portion integrally connected with the high heel portion, so that the protruding tongue portion is tightly positioned within an elongated closed cavity on the platform structure, and thereby forms a one piece sole to be attached to the upper.

It is a further object of the present invention to provide an alignment anchor sustained by the protruding tongue portion of the heel structure, which projects within an alignment aperture provided in the platform structure to prevent accidental relative lateral movements of the high heel portion with respect to the platform structure, thereby maintaining the position of the heel portion with respect to the platform structure.

In the preferred embodiment of the present invention, the two piece shoe bottom construction comprises a platform structure and a heel structure with a heel portion and a downwardly inclined protruding tongue portion.

In an alternative embodiment of the present invention, the two piece shoe bottom construction comprises a platform structure and a heel structure with a high heel portion and a downwardly inclined protruding tongue with a metal steel shank encapsulated within the protruding tongue.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
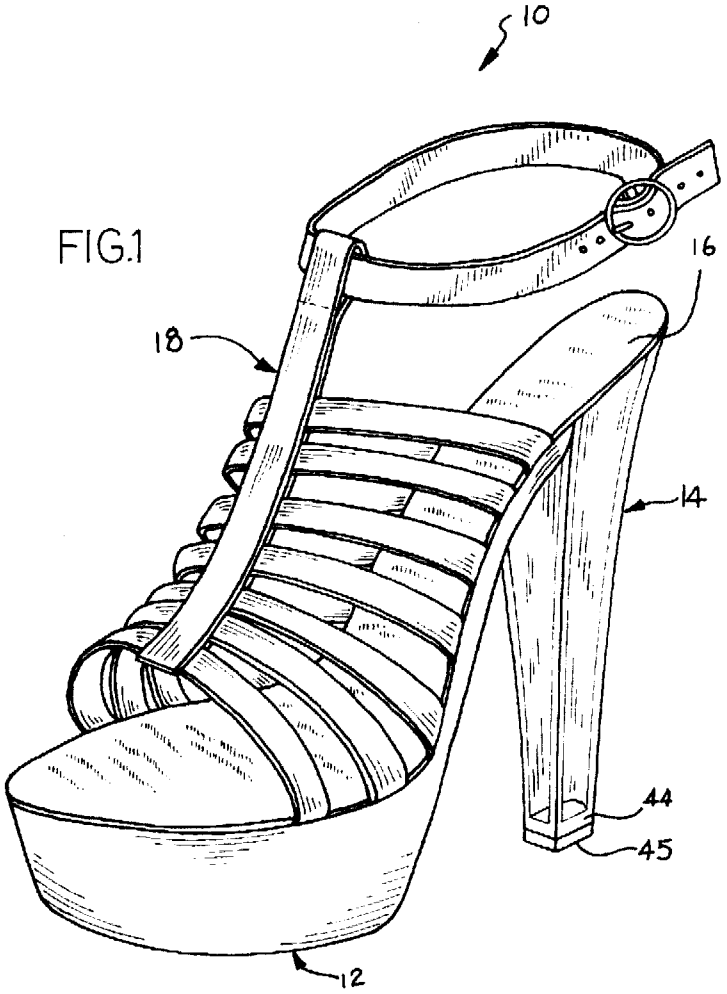
FIG. 1 is a perspective view of the finished shoe utilizing the present invention.

Referring to FIG. 1, there is depicted at 10 a complete left shoe. The shoe 10 comprises a platform 12, a hollow high heel 14, an insole 16 which overlies the platform 12 and leather straps or upper 18 attached between the insole 16 and the platform 12 for securing a user's foot to the shoe 10.

Figure 2:
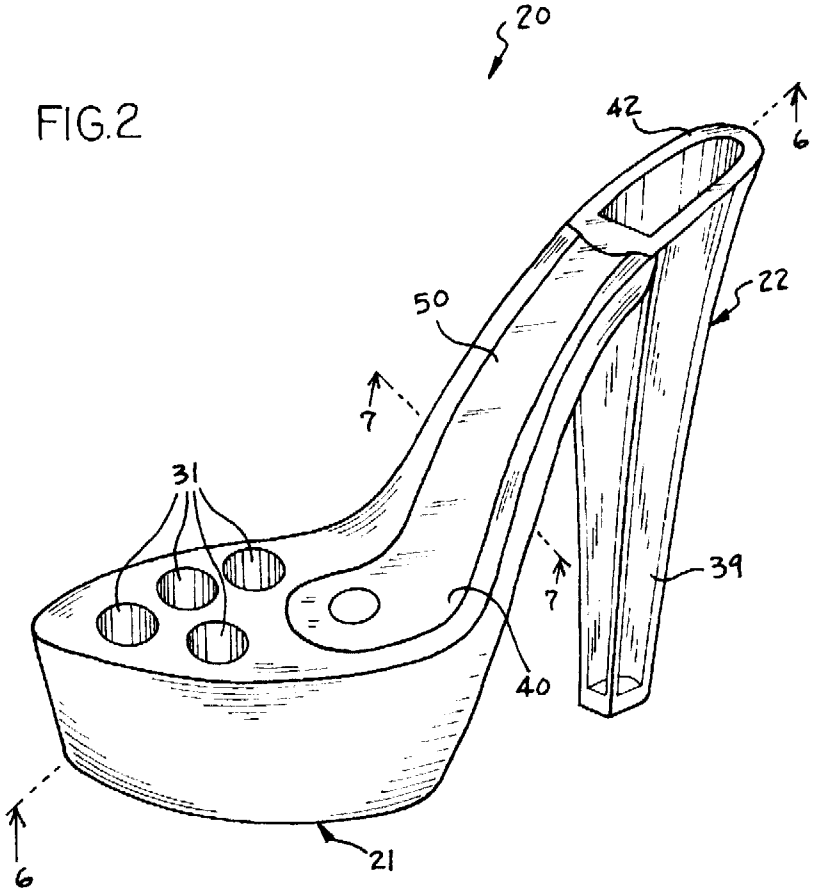
FIG. 2 is a perspective view of the preferred embodiment of the present invention, showing the two piece shoe bottom construction.

Referring to FIG. 2, there is shown at 20 a perspective view of the preferred embodiment of the present invention two piece shoe bottom construction. The shoe bottom 20 comprises a platform structure 21 and a heel structure 22.

Figure 3:
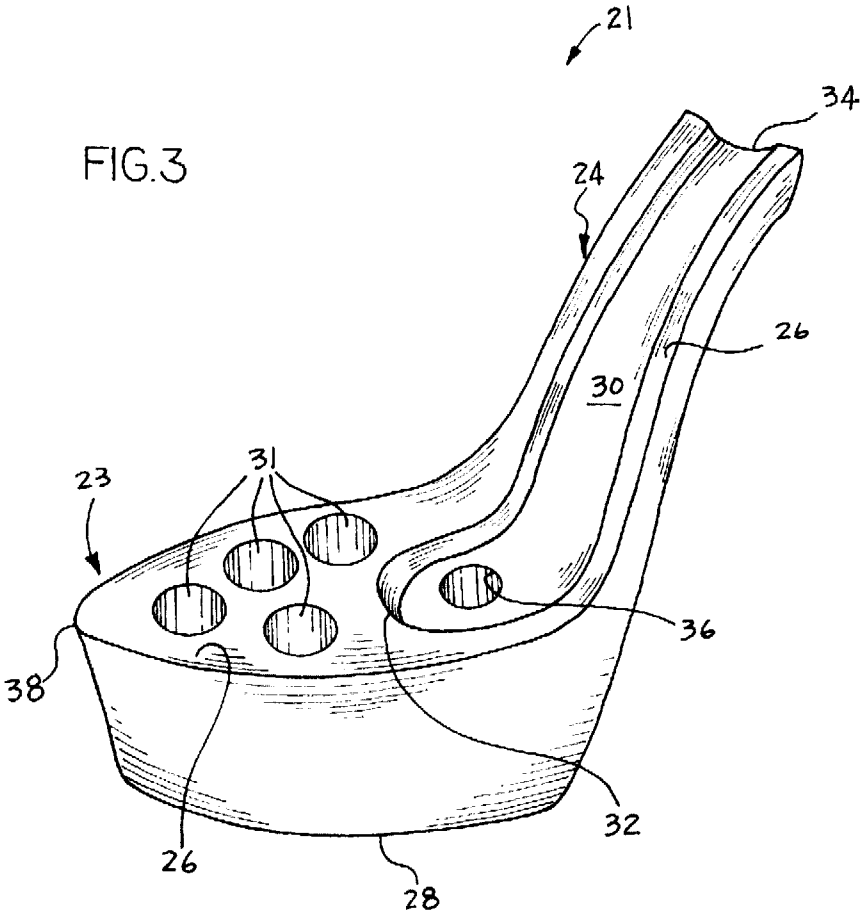
FIG. 3 is a perspective view of the platform structure of the present invention.
Figure 4:
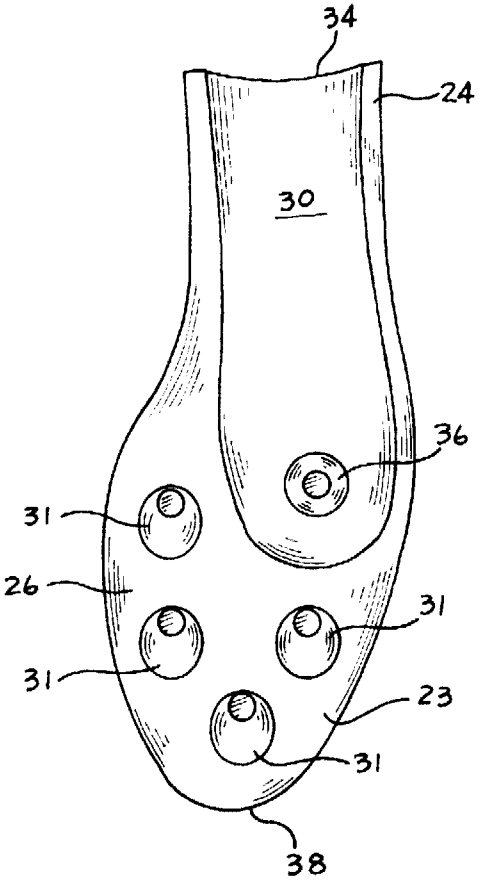
FIG. 4 is a top plan view of the platform structure of the present invention.

FIG. 3 shows a perspective view of the platform structure 21. FIG. 4 shows a top plan view of the platform structure 21. Referring to FIGS. 2, 3 and 4, the platform structure 21 comprises a forward toe portion 23, a rear raised portion 24, an upper side 26, and a lower side 28. An elongated closed cavity or recess 30 is provided on the upper side 26 of the platform structure 21 and extends from a middle 32 of the toe portion 23 through an end 34 of the rear raised portion 24. The forward toe portion 23 has an alignment aperture 36 which is provided centrally and located within the closed cavity 30, and a multiplicity of closed weight reducing holes 31 for reducing the weight of the platform structure 21 and located adjacent to a front end 38 of the toe portion 23. The depth of each closed weight reducing hole 31 has a depth which is approximately half the thickness of the toe portion 23 (see FIG. 6).

Figure 5:
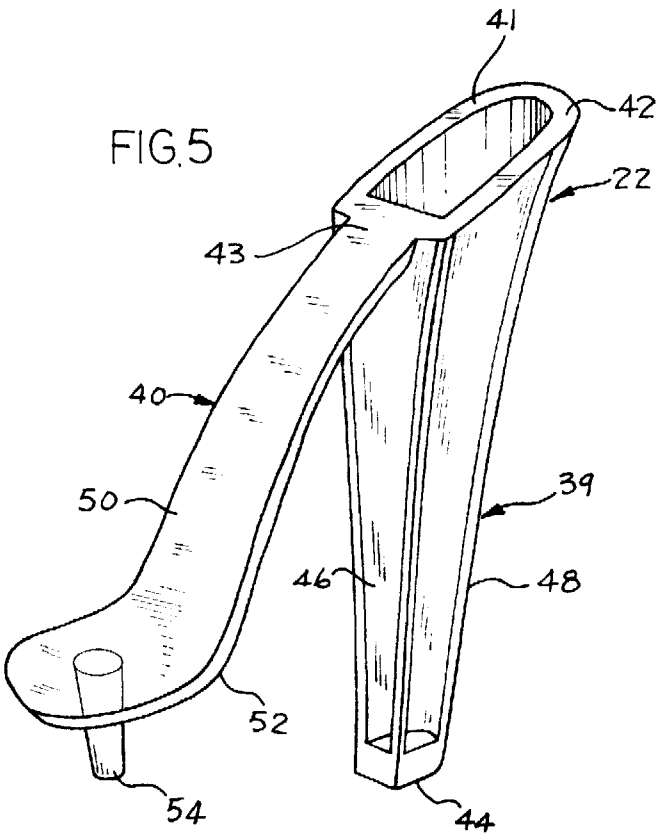
FIG. 5 is a perspective view of the heel structure of the present invention.

Referring to FIG. 5, there is shown a perspective view of the heel structure 22 which comprises a high heel portion 39 that has a hollow cavity 41 for reducing the weight of the heel structure 22 and a downwardly inclined protruding tongue portion 40. The high heel portion 39 has a top surface 42, a bottom tip 44, a front side 46, and a curved rear surface 48. A top-lift 45 may be used with the high heel portion 39 and is attached to the bottom tip 44 (see FIG. 1). The protruding tongue portion 40 has one end 43 which is integrally connected to the front side 46 of the high heel portion 39 and located adjacent to the top surface 42. The protruding tongue portion 40 further has an upper side 50 and a concave shaped lower side 52 which is shaped similar to the recess 30 of the platform structure 21. An alignment anchor or shaft means 54 is integrally formed to the concave shaped lower side 52 of the protruding tongue portion 40 and located remote from the heel portion 39. The alignment anchor 54 projects within the alignment aperture 36 of the platform structure 21 for stabilizing the high heel portion 39 from lateral movements (see FIG. 6) when a wearer walks on the shoe.

Figure 7:
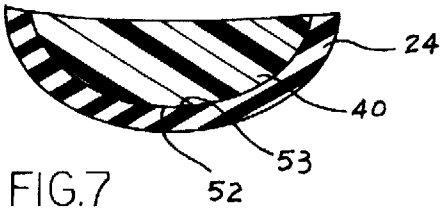
FIG. 7 is an enlarged cross-sectional view taken along line 7—7 of FIG. 2.
Figure 6:
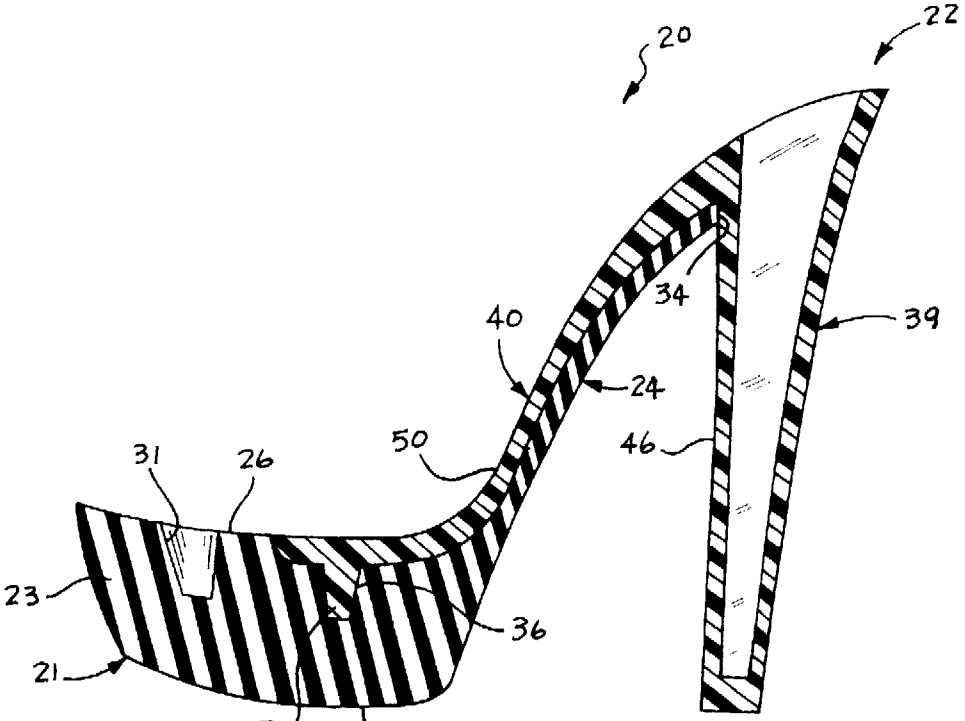
FIG. 6 is a cross-sectional view taken along line 6—6 of FIG. 2.

Referring to FIG. 6, there is shown at 20 a cross-sectional view of the present invention two piece shoe bottom construction. The protruding tongue portion 40 is installed within the closed cavity 30 of the platform structure 21, where the concave shaped lower side 52 is abutting against the interior surface 53 of the closed cavity 30 (see FIG. 7), and the front side 46 of the high heel portion 39 abuts against the end 34 of the rear raised portion 24 of the platform structure 21. Once the protruding tongue portion 40 is secured within the closed cavity 30 of the platform structure 21 by conventional means, e.g., gluing, the upper side 50 of the protruding tongue portion 40 is flush with the upper side 26 of the platform structure 21.

Referring again to FIGS. 1 and 2, the insole 16 covers the entire upper sides 26 and 50 of the platform structure 21 and the protruding tongue portion 40 respectively, and the top surface 42 of the high heel portion 39.

What is unique about the heel structure 22 is that the material used has a memory function such that if the protruding tongue portion 40 is bent and released, it will return to its initial position because of the memory function.

Figure 8:
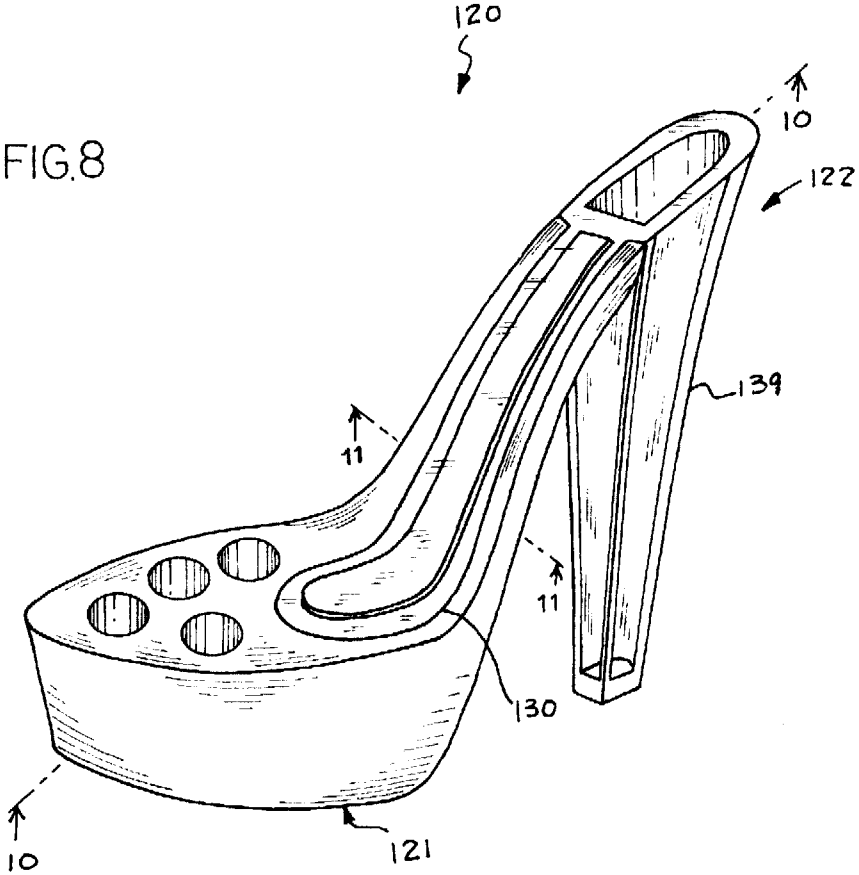
FIG. 8 is a perspective view of an alternative embodiment of the present invention, showing the two piece shoe bottom construction.

Referring to FIG. 8, there is shown at 120 a perspective view of an alternative embodiment of the present invention two piece shoe bottom construction. The shoe bottom 120 comprises a platform structure 121 and a heel structure 122.

It assembles and functions the same as previously described above except that a modified heel structure 122 is substituted for the previous heel structure 22 shown in FIGS. 1 through 7. The platform structure 121 used in this embodiment is identical to the one previously described in FIGS. 1 through 7, and the description thereof will not be repeated and only the modified components will be described in detail. In this embodiment, the components are numbered correspondingly with 100 added to each number.

Figure 9:
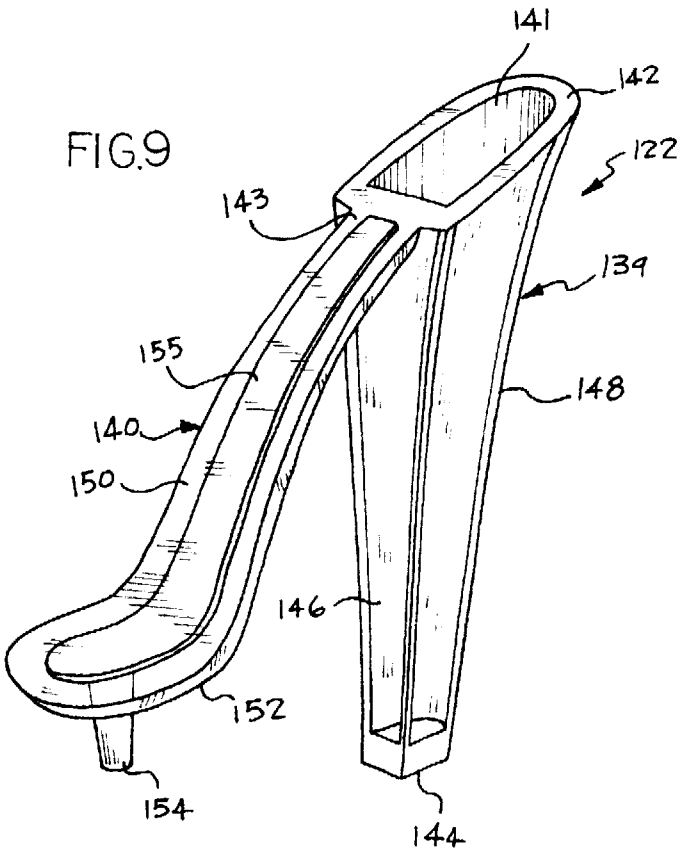
FIG. 9 is a perspective view of the heel structure of the alternative embodiment of the present invention.

Referring to FIG. 9, there is shown a perspective view of the heel structure 122 which comprises a high heel portion 139 that has a hollow cavity 141 for reducing the weight of the heel structure 122 and a downwardly inclined protruding tongue portion 140. The high heel portion 139 has a top surface 142, a bottom tip 144, a front side 146, and a curved rear surface 148. A top-lift (not shown) may also be used with this embodiment and is attached to the bottom tip 144 of the heel portion 139. The protruding tongue portion 140 has one end 143 which is integrally connected to the front side 146 of the high heel portion 139 and located adjacent to the top surface 142. The protruding tongue portion 140 further has an upper side 150 and a concave shaped lower side 152 which is shaped similar to the recess 130 of the platform structure 121. An alignment anchor or shaft means 154 is integrally formed with the concave shaped lower side 152 of the protruding tongue portion 140 and located remote from the heel portion 139. The alignment anchor 154 projects within the alignment aperture 136 of the platform structure 121 for stabilizing the high heel portion 139 from lateral movements (see FIG. 6) when a wearer walks on the shoe.

Figure 10:
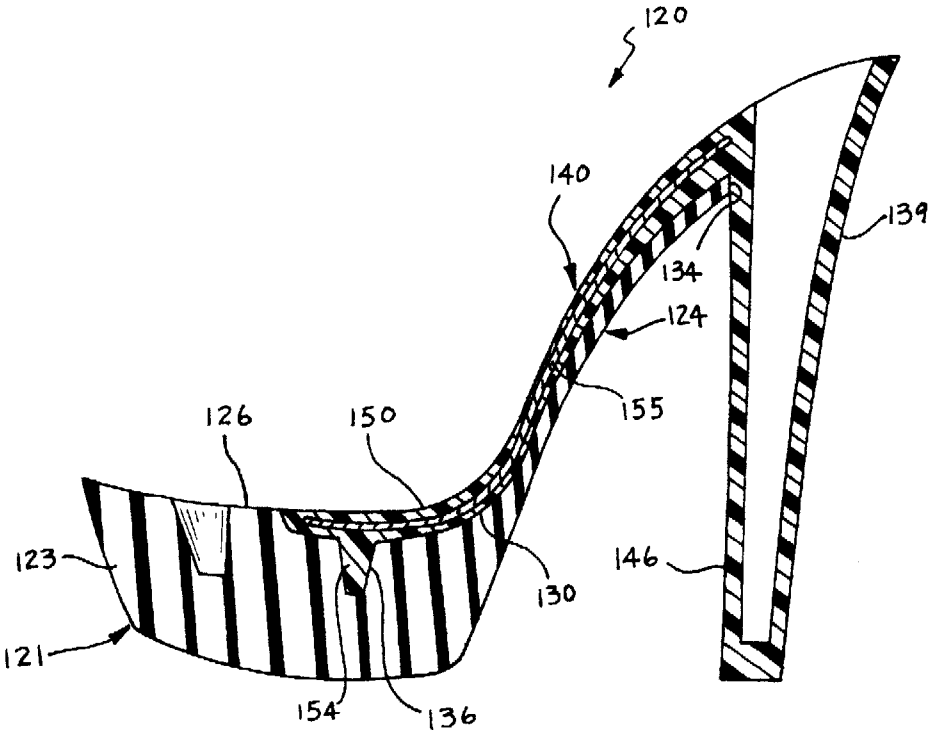
FIG. 10 is a cross-sectional view taken along line 10—10 of FIG. 8.

Referring to FIG. 10, there is shown at 120 a cross-sectional view of the present invention two piece shoe bottom construction. An elongated metal steel shank 155 is encapsulated within the protruding tongue portion 140 for providing additional support thereto. This method of enclosing the metal steel shank 155 is known to one skilled in the art, and will not be described in detail since the inventor is not patenting the method of encapsulating the metal steel shank within the protruding tongue portion 140 of the present invention. The metal steel shank 155 is used only if additional strength is required for high heels.

Figure 11:
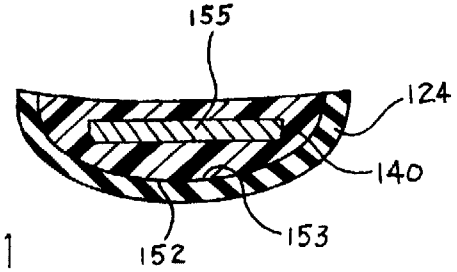
FIG. 11 is an enlarged cross-sectional view taken along line 11—11 of FIG. 8.

The protruding tongue portion 140 is installed within the closed cavity 130 of the platform structure 121, where the concave shaped lower side 152 is abutting against the interior surface 153 of the closed cavity 130 (see FIG. 11), and the front side 146 of the high heel portion 139 abuts against the end 134 of the rear raised portion 124 of the platform structure 121. Once the protruding tongue 140 is secured within the closed cavity 130 of the platform structure 121 by conventional means, e.g., gluing, the upper side 150 of the protruding tongue portion 140 is flush with the upper side 126 of the platform structure 121.

The insole 16 covers the entire upper sides 126 and 150 of the platform structure 121 and the protruding tongue portion 140 respectively, and the top surface 142 of the high heel portion 139 (see FIG. 1).

The present invention conforms to conventional forms of manufacture, and is of simple construction and is easy to use. The two piece shoe construction can be made from several materials. The manufacturing process which could accommodate the construction of the two piece shoe construction may be injection molded, thermoformed, etc. or other molding process. By way of example, the platform structure can be made of hard rubber material, thermoplastic material or any other suitable material, for example, polyurethane material. The material will be strong and abrasion-resistant. By way of example, the heel structure can be made of plastic material, for example, poly carbonate plastic, ABS plastic or nylon plastic. The molding and mass production process would enable the shoe to be produced inexpensively.

It will be appreciated that the heel structure is not limited to the translucent plastic material. It is also within the spirit and scope of the present invention to have a multiplicity of color plastic material for the heel structure or may be covered with leather or upper material.

The figures have illustrated a heel structure that has a thick high heel portion. It will be appreciated that the heel structure can have several different heel portions, such as a slender high heel portion, a medium heel portion or a low walking heel portion. If the slender high heel portion is used, then the slender high heel portion will not have a hollow cavity but rather a solid portion.

Figure 12:
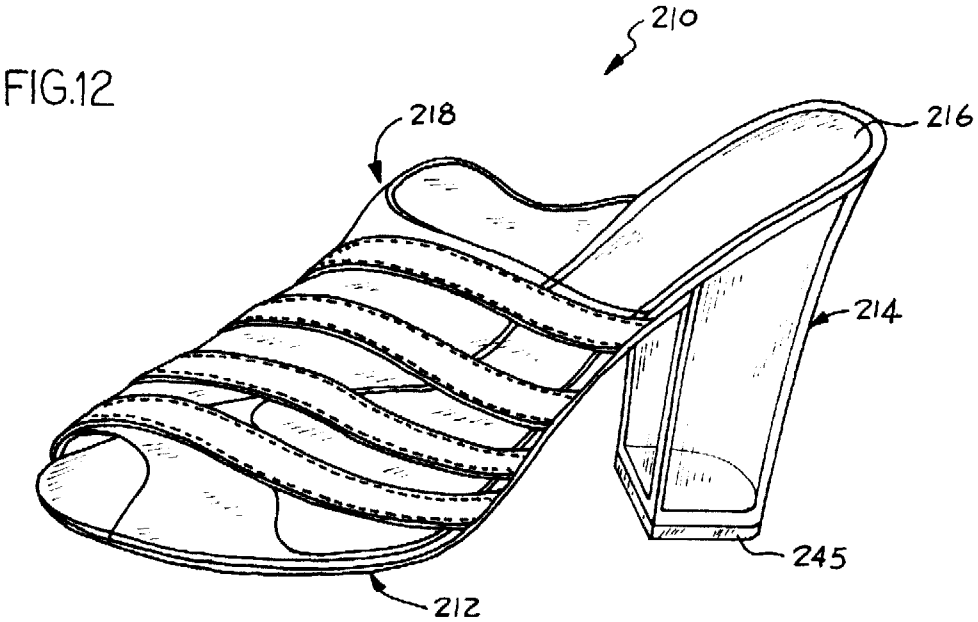
FIG. 12 is a perspective view of another embodiment of the finished shoe utilizing the present invention.

Referring to FIG. 12, there is depicted at 210 an entire low heel left shoe. The shoe 210 comprises a platform 212, a hollow low heel 214, an insole 216 which overlies the platform 212 and an upper 218 attached between the insole 216 and the platform 212 for securing a user's foot to the shoe 210.

Figure 13:
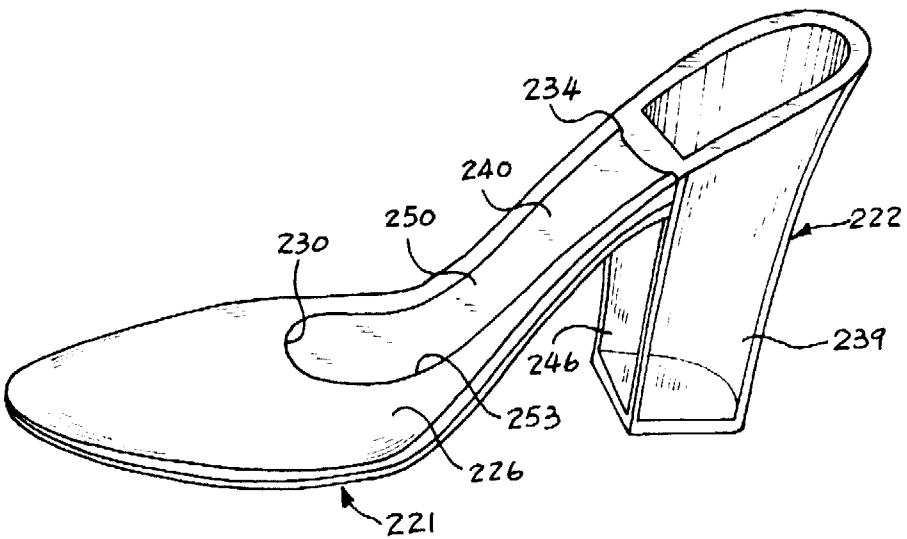
FIG. 13 is a perspective view of the two piece shoe bottom construction of the other embodiment of the present invention shown in FIG. 12.

Referring to FIG. 13, there is shown at 220 a perspective view of another embodiment of the present invention two piece shoe bottom construction. The shoe bottom 220 comprises a reduced platform structure 221 and a heel structure 222. In this embodiment, the anchor is eliminated because with a lower heel, the heel portion does have the tendency to move laterally, and therefore the anchor is not required.

Figure 14:
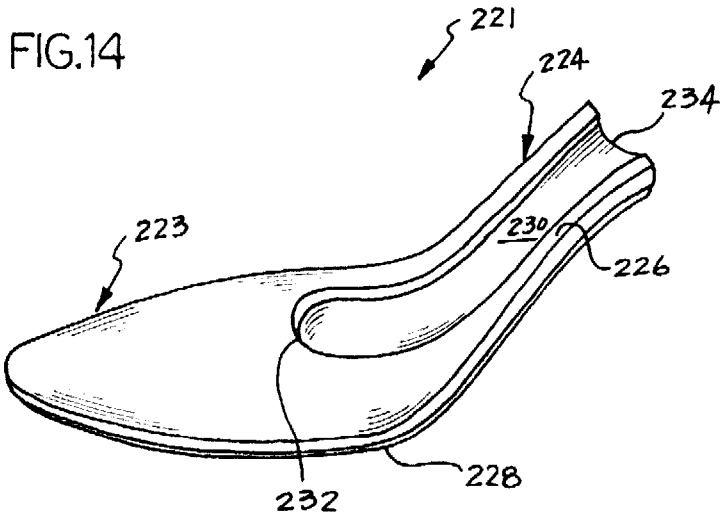
FIG. 14 is a perspective view of the platform structure of the other embodiment of the present invention shown in FIG. 13.

Referring to FIG. 14, there is shown at 221 a perspective view of the platform structure. The platform structure 221 comprises a reduced forward toe portion 223, a semi-raised portion 224, an upper side 226, and a lower side 228. An elongated closed cavity or recess 230 is provided on the upper side 226 of the platform structure 221 and extends from a middle 232 of the toe portion 223 through an end 234 of the semi-raised portion 224.

Figure 15:
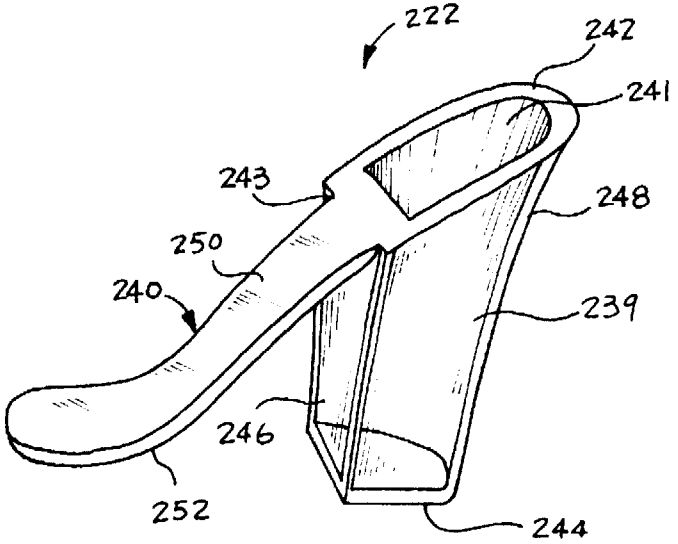
FIG. 15 is a perspective view of the heel structure of the other embodiment of the present invention shown in FIG. 13.

Referring to FIG. 15, there is shown at 222 a perspective view of the heel structure which comprises a low heel portion 239 that has a hollow cavity 241 for reducing the weight of the heel structure 222 and a semi-downwardly inclined protruding tongue portion 240. The heel portion 239 has a top surface 242, a bottom tip 244, a front side 246, and a curved rear surface 248. A top-lift 245 may also be used with the heel portion 239 and is attached to the bottom tip 244 (see FIG. 12). The protruding tongue portion 240 has one end 243 which is integrally connected to the front side 246 of the heel portion 239 and located adjacent to the top surface 242. The protruding tongue portion 240 further has an upper side 250 and a concave shaped lower side 252 which is shaped similar to the closed cavity 230 of the platform structure 221.

Referring again to FIGS. 13 and 14, the protruding tongue portion 240 is installed within the closed cavity 230 of the platform structure 221, where the concave shaped lower side 252 is abutting against the interior surface 253 of the closed cavity 230, and the front side 246 of the heel portion 239 abuts against the end 234 of the semi-raised portion 224 of the platform structure 221. Once the protruding tongue portion 240 is secured within the closed cavity 230 of the platform structure 221 by conventional means, e.g., gluing, the upper side 250 of the protruding tongue portion 240 is flush with the upper side 226 of the platform structure 221.

Referring again to FIG. 12, the insole 216 covers the entire upper sides 226 and 250 of the platform structure 221 and the protruding tongue portion 240 respectively, and the top surface 242 of the heel portion 239.

Defined in detail, the present invention is a shoe bottom system, comprising: (a) a platform structure having an upper side, a lower side, a rear raised portion with a rear end and a forward toe portion with a middle, the upper side having a closed cavity extending from the middle of the toe portion through the rear end of the rear raised portion and an alignment aperture located on the closed cavity and adjacent to the forward toe portion; (b) a heel structure having a hollow high heel portion with a front side and a top surface, and a downwardly inclined protruding tongue portion integrally connected to the front side and located adjacent to the top surface, the protruding tongue portion having an upper side and a concave shaped lower side; and (c) an alignment anchor integrally connected to the concave shaped lower side of the protruding tongue portion and projecting within the alignment aperture of the platform structure for stabilizing the high heel portion from lateral movements, where the concave shaped lower side of the protruding tongue portion is secured within the closed cavity of the platform structure such that the front side of the high heel portion abuts against the rear end of the rear raised portion of the platform structure and the upper side of the protruding tongue portion lies flush with the upper side of the platform structure.

Defined broadly, the present invention is a shoe bottom system, comprising: (a) a platform having a rear raised portion with an end, a forward toe portion with a middle, a closed cavity extending from the middle of the toe portion through the end of the rear raised portion and an aperture located on the closed cavity and adjacent to the forward toe portion; (b) a heel having a heel portion with a front side and a top surface, and a protruding tongue portion connected to the front side and located adjacent to the top surface; and (c) a shaft connected to the protruding tongue portion and projecting within the aperture of the platform for stabilizing the heel portion from lateral movements, where the protruding tongue portion is secured within the closed cavity of the platform such that the front side of the heel portion abuts against the end of the rear raised portion of the platform.

Defined more broadly, the present invention is a shoe bottom, comprising: (a) a platform having a recess; and (b) a heel having a heel portion and a tongue portion, where the tongue portion is secured within the recess of the platform.

Defined alternatively in detail, the present invention is a shoe bottom system, comprising: (a) a platform structure having an upper side, a lower side, a rear raised portion with an end and a forward toe portion with a middle, the upper side having a closed cavity extending from the middle of the toe portion through the end of the rear raised portion and an alignment aperture located on the closed cavity and adjacent to the forward toe portion; (b) a heel structure having a hollow high heel portion with a front side and a top surface, and a downwardly inclined protruding tongue portion connected to the front side and located adjacent to the top surface, the protruding tongue portion having an upper side and a concave shaped lower side; (c) a metal shank encapsulated within the protruding tongue portion for providing high strength; and (d) an alignment anchor connected to the concave shaped lower side of the protruding tongue portion and projecting within the alignment aperture of the platform structure for stabilizing the high heel portion from lateral movements, where the concave shaped lower side of the protruding tongue portion is secured within the closed cavity of the platform structure such that the front side of the high heel portion abuts against the end of the rear raised portion of the platform structure and the upper side of the protruding tongue portion lies flush with the upper side of the platform structure.

Defined alternatively broadly, the present invention is a shoe bottom, comprising: (a) a platform having a recess; (b) a heel having a heel portion and a tongue portion, where the tongue portion is secured within the recess of the platform; and (c) a metal shank encapsulated within the tongue portion.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shoe bottom system, comprising:

a. a bottom structure having an upper side, a lower side, a rear semi-raised portion with a rear end and a forward toe portion with a middle, the upper side having a closed cavity extending from the middle of the toe portion through the rear end of the rear semi-raised portion;

b. a heel structure having a hollow low heel portion and a downwardly inclined protruding tongue portion, the low heel portion having a front side and a top surface, the protruding tongue portion having an upper side and a concave shaped lower side, where the protruding tongue portion is integrally connected to the front side of the low heel portion and located adjacent to the top surface; and c. said concave shaped lower side of said protruding tongue portion securely attached within said closed cavity of said bottom structure such that said front side of said low heel portion abuts against said rear end of said rear semi-raised portion of said bottom structure and said upper side of said protruding tongue portion lies flush with said upper side of said bottom structure.

2. The shoe bottom system in accordance with claim 1 further comprising an insole covering the entire upper sides of said bottom structure and said protruding tongue portion respectively, and said top surface of said low heel portion.

3. The shoe bottom system in accordance with claim 2 further comprising an upper attached between said insole and said bottom structure for securing a user's foot to said shoe bottom system.

4. The shoe bottom system in accordance with claim 1 wherein said low heel portion is transparent.

5. The shoe bottom system in accordance with claim 1 wherein said heel structure is made of poly carbonate plastic material.

6. The shoe bottom system in accordance with claim 1 wherein said heel structure is made of nylon material.

7. The shoe bottom system in accordance with claim 1 wherein said bottom structure is made of polyurethane material.

* * * * *